United States Patent [19]

Velezis

[11] Patent Number: 5,056,252

[45] Date of Patent: Oct. 15, 1991

[54] FIREARM MAGAZINE

[76] Inventor: George A. Velezis, 175 Skyline Dr., Middlebury, Conn. 06762

[21] Appl. No.: 611,488

[22] Filed: Oct. 18, 1990

Related U.S. Application Data

[60] Continuation-in-part of Ser. No. 429,798, Oct. 31, 1989, abandoned, which is a division of Ser. No. 375,835, Jul. 5, 1989, Pat. No. 5,027,541.

[51] Int. Cl.[5] ..... F41A 9/71

[52] U.S. Cl. ..... 42/50; 42/18; 42/49.020

[58] Field of Search ..... 42/7, 18, 49.02, 50; 89/33.17

[56] References Cited

U.S. PATENT DOCUMENTS

| | | | |
|---|---|---|---|
| 283,122 | 8/1883 | Lewis . | |
| 449,988 | 4/1891 | Whitelaw . | |
| 1,401,152 | 12/1921 | Green . | |
| 1,433,945 | 10/1922 | Eickhoff . | |
| 2,296,729 | 9/1942 | Mossberg . | |
| 2,396,816 | 3/1946 | Boudreau . | |
| 2,507,364 | 5/1950 | Benson . | |
| 2,895,248 | 7/1959 | Sawin . | |
| 3,043,198 | 7/1962 | Darsie et al. . | |
| 3,399,479 | 9/1968 | Goldstein . | |
| 3,399,480 | 9/1968 | Rowe, Jr. | 42/50 |
| 4,139,959 | 2/1979 | Howard et al. . | |
| 4,708,049 | 11/1987 | Durant et al. . | |
| 4,864,758 | 9/1989 | Crossman . | |
| 4,867,039 | 9/1989 | Dobbins . | |

FOREIGN PATENT DOCUMENTS

| | | | |
|---|---|---|---|
| 148756 | 7/1950 | Australia | 89/33.17 |
| 729899 | 3/1966 | Canada | 42/50 |
| 8808113 | 10/1988 | PCT Int'l Appl. | 42/50 |
| 584743 | 1/1947 | United Kingdom | 42/50 |

*Primary Examiner*—Richard W. Wendtland
*Attorney, Agent, or Firm*—McCormick, Paulding & Huber

[57] ABSTRACT

A pump action shotgun loaded from a magazine tube has a box magazine which feeds successive rounds of ammunition into the magazine tube through an opening in the side of the tube. Each successive round of ammunition is fed from the magazine tube into the receiver of the gun by a plunger connected by a rack and pinion mechanism to an action bar which moves the breech bolt between its retired and battery positions. The rack and pinion mechanism maintains the plunger out of the path of a round of ammunition fed into the magazine tube from the box magazine when the breech bolt is in its battery position and moves the plunger through a distance greater than the distance between the retired and battery positions to move a round of ammunition from the magazine tube into the receiver when the breech bolt moves from its battery to its retired position. The box magazine is adjustable to accommodate shells of differing lengths.

25 Claims, 3 Drawing Sheets

FIREARM MAGAZINE

This is a continuation-in-part of co-pending application Ser. No. 429,798 filed on Oct. 31, 1989 now abandoned, which is a division of application Ser. No. 375,835 filed July 5, 1989 now U.S. Pat. No. 5,027,541.

BACKGROUND OF THE INVENTION

This invention relates in general to firearm loading apparatus and deals more specifically with improvements in magazine tube loaded firearms, particularly shotguns.

Shotguns of magazine tube loaded type have a long record of proven dependability and are widely used by sportsmen. However, such firearms have gained only limited acceptance by law enforcement agencies and the military, because of the time required for reloading.

It is the general aim of the present invention to provide an improved firearm of the type having an action particularly adapted for loading from a magazine tube and which employs an improved box type magazine to facilitate rapid loading and increase firepower.

SUMMARY OF THE INVENTION

In accordance with the present invention an improved firearm magazine for containing a plurality of rounds of ammunition comprises a housing having a bottom wall, a pair of opposing sidewalls and opposing front end rear walls which cooperate to define an opening at the upper end of the housing through which successive rounds of ammunition are received into and released from the magazine. The magazine also includes follower means for biasing rounds of ammunition contained within the housing in the direction of the opening and adjusting means for selectively changing the effective length of the interior of the housing to accommodate rounds of ammunition of differing lengths. The adjusting means comprises a plurality of vertically disposed opposing guide tracks on the opposing sidewalls of the housing and an elongated spacer for selectively positioning within the housing in an associated one of the tracks.

DETAILED DESCRIPTION OF PREFERRED EMBODIMENT

Figure 1:
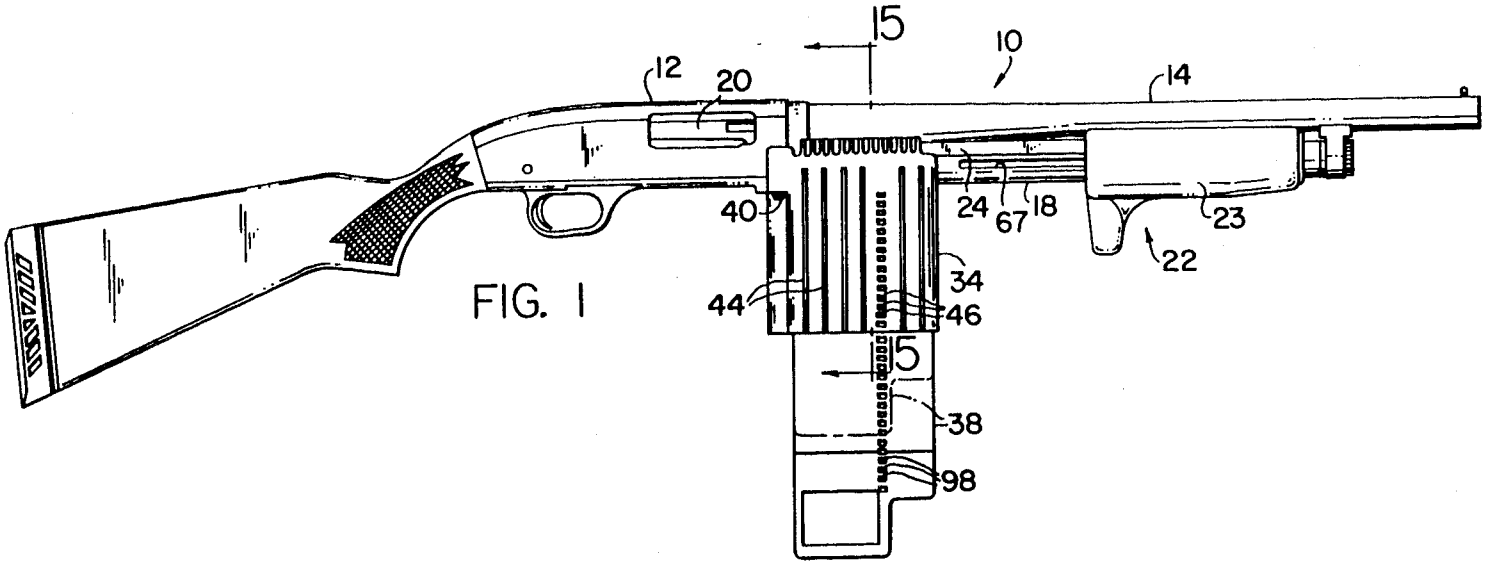
FIG. 1 is a side elevational view of a shotgun embodying the present invention.

Turning now to the drawings, a firearm or shotgun embodying the present invention is indicated generally by the reference numeral 10. The illustrated shotgun 10 is a modified MOSSBERG Model 500 pump action shotgun, manufactured and marketed by O. F. Mossberg & Sons, Inc., North Haven, Conn. Since the basic gun 10 is of a well-known type, only those parts of the gun essential to an understanding of the invention will be described in detail.

Further referring to the drawings, the gun 10 has a receiver 12 and a barrel 14 which projects forwardly from the receiver and includes a bore which communicates with the interior of the receiver. A magazine tube 18 projects forwardly from the receiver in generally axially parallel relation to the barrel and also communicates with the interior of the receiver. A breech bolt 20, supported within the receiver 12 for reciprocal sliding movement between battery and retired positions, is connected to a bolt actuating mechanism, indicated generally at 22, which includes a manually moveable forearm 23 and an action bar assembly 24 connected to the forearm 23 and to the breech bolt 20. A plurality of rounds of ammunition or shells are usually stored within the magazine tube 18 of the unmodified gun and urged in the direction of the receiver by a plunger assembly indicated generally at 26 which includes a plunger 28 and a plunger spring 30, all of which is well-known in the shotgun art.

When the action is opened by manually moving the forearm 23 in a rearward direction toward the receiver 12 the action bar 24 moves the breech bolt 20 to its retired or open position causing an elevator (not shown) to move to a shell receiving position and releases a shell interrupter and a shell stop, located within the receiver but not shown, which allow the shell to move from the magazine tube into the receiver and to a loading position in response to biasing force applied to the shell by the plunger assembly 26. Return movement of the forearm 23 in forward direction causes the shell interrupter to arrest rearward movement of the next successive shell in the magazine tube 18 to prevent it from entering the receiver 12 while the elevator moves the shell within the receiver from its loading position into the path of the returning breech bolt 20 whereby the shell is chambered by the breech bolt as the breech bolt moves into battery position in an manner well known in the shotgun art.

In accordance with the present invention, the modified shotgun 10 is loaded from a box type magazine and has an ammunition or shell receiving opening 32 through the sidewall of the magazine tube 18 immediately forward of the receiver 12. A magazine shroud 34 mounted in fixed position relative to the magazine tube and has an magazine well opening 36 therethrough in general registry with the shell receiving opening 32.

The magazine shroud 34 is adapted to receive a box magazine 38 for containing a plurality of shotgun shells S,S, releasing each shell in succession and biasing the released shell through the shell receiving opening 32 and to a ready position within the magazine tube 18 wherein the shell is generally coaxially aligned with the magazine tube. Since only one shell is disposed within the magazine tube 18 at any given time, a shell interrupter is not a required element of the improved firearm 10 and is not included as part of the improved structure.

Further, and accordance with the invention, the plunger assembly 26 is connected to the bolt actuating mechanism, or more specifically to the action bar assembly 24, which maintains the plunger assembly 26 in a position forward of the ready position when the breech bolt 20 is in its battery position and which moves the plunger assembly in the direction of the receiver 12 to bias a shell from the ready position into the receiver and to a loading position therein when the bolt actuating mechanisms is operated to move the breech bolt from its battery position to its retired position, all of which will be hereinafter more fully discussed.

Considering now the firearm 10 in further detail, the magazine shroud 34 is preferably secured in fixed position to the receiver by threaded fasteners 40 (one shown in FIG. 1) and has a manually operable magazine catch 42 for releasably securing a magazine therein, such as the box magazine 38. The magazine shroud 34 may be made from any suitable material, but preferably it is molded from a durable plastic material and has a plurality of parallel spaced apart and vertically extending ribs 44,44 which project both inwardly and outwardly from the opposite side walls thereof. A vertical series of small window openings 46,46 are formed through at least one sidewall of the magazine shroud, for a purpose for which will hereinafter be discussed.

Figure 2:
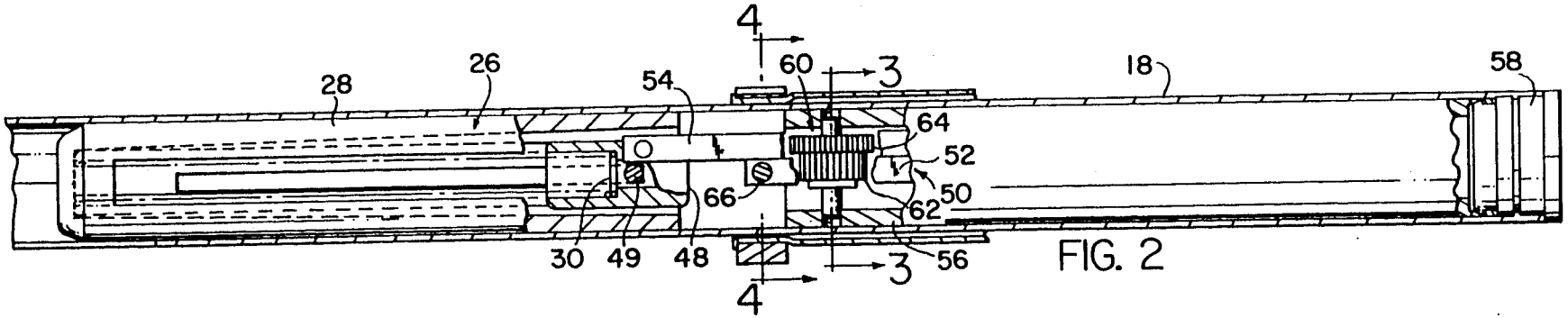
FIG. 2 is a somewhat enlarged fragmentary axial sectional view through the magazine tube of the shotgun of FIG. 1.

The hollow elongated tubular plunger 28, which comprises part of the plunger assembly 26, is slidably received within the magazine tube 18 and contains a generally cylindrical spring support member 48. The spring support member is retained within the plunger for limited axial sliding movement relative to the plunger by a pin 49 carried by the spring support member and which projects into a slot in the plunger. The plunger spring 30 is also contained within the plunger 28 and acts between the plunger and the spring support 48, substantially as shown in FIG. 2.

The plunger assembly 26 is connected to the action bar 24 by a rack and pinion mechanism indicated generally at 50 which includes a forearm rack 52 and a follower rack 54.

Figure 4:
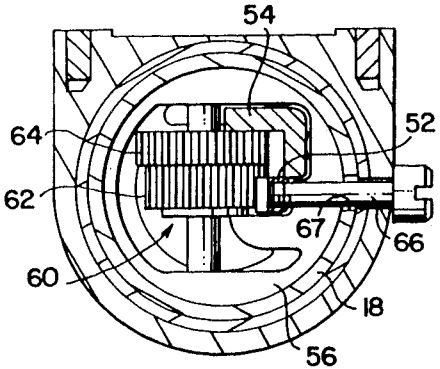
FIG. 4 is a somewhat enlarged sectional view taken along the line 4—4 of FIG. 2.
Figure 15:
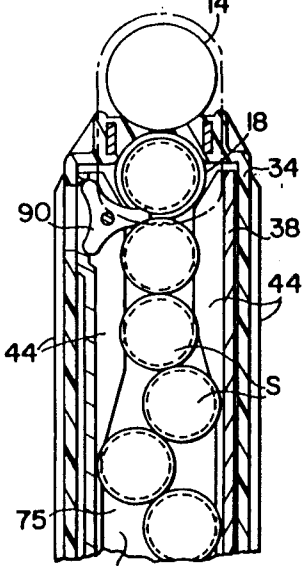
FIG. 15 is a somewhat enlarged fragmentary sectional view taken along the line 15—15 of FIG. 1.
Figure 3:
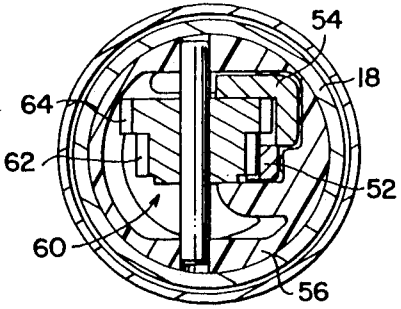
FIG. 3 is a somewhat enlarged fragmentary sectional view taken along the line 3—3 of FIG. 2.
Figure 5:
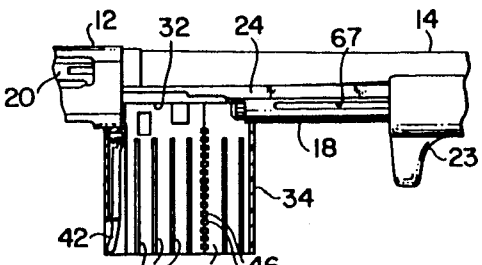
FIG. 5 is a fragmentary sectional view similar to FIG. 1 but showing the magazine shroud in longitudinal section with the magazine removed therefrom.

The racks 52 and 54 are supported by and travel within guideways formed within a generally cylindrical rack housing 56 disposed within the forward end portion of the magazine tube 18 and retained therein by a magazine rack plug 58. A gear wheel and pinion assembly indicated generally at 60 and journalled for rotation about a vertical axis within the rack housing 56, and best shown in FIGS. 2–4, includes a gear wheel 62 disposed in meshing engagement with the forearm rack 52 and a pinion 64 supported for coaxially rotation with the gear wheel 62 and disposed in meshing engagement with the follower rack 54. The rear end portion of the follower rack 54 is pinned to the spring support member 48 which comprises part of the plunger assembly. The rear end portion of the forearm rack 52 is connected to the action bar assembly by a threaded stud 66 which extends through the action slide tube, passes through an axially elongated slot 67 in the sidewall of the magazine tube, and is threadably engaged in the rear end portion of the forearm rack 52, as shown in FIG. 4.

Figure 7:
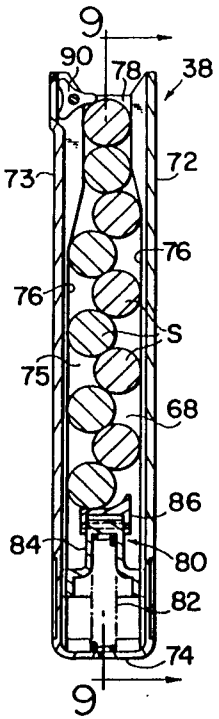
FIG. 7 is a sectional view taken along the line 7—7 of FIG. 6.
Figure 6:
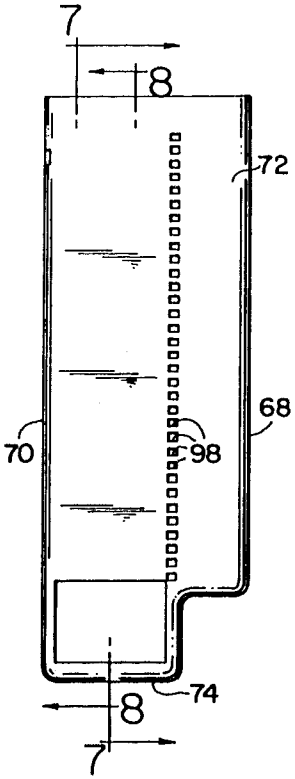
FIG. 6 is a side elevational view of the box magazine.
Figures 8, 9, 10, 11, 12, 13, 14, 16:
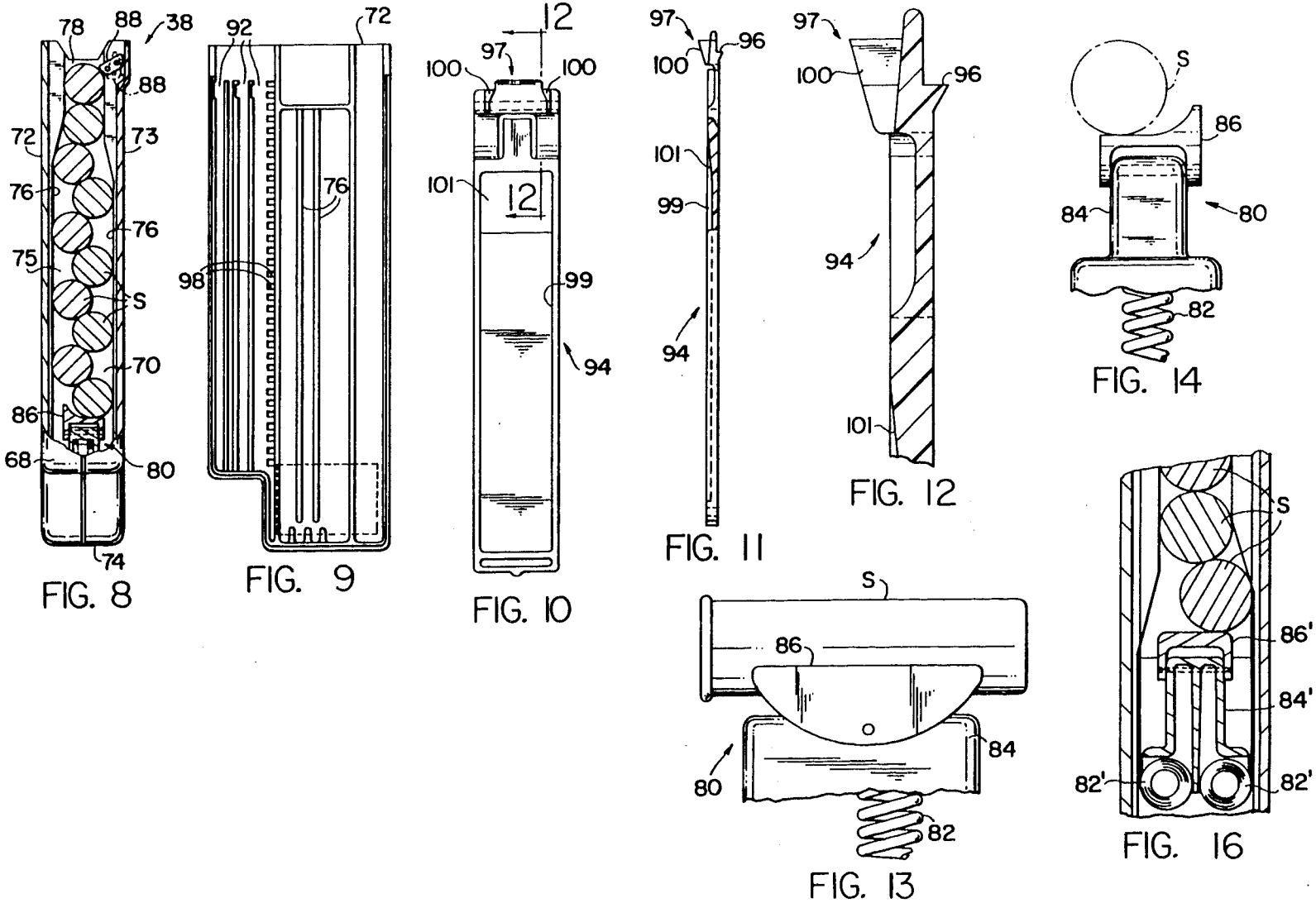
FIG. 8 is a sectional view taken along the line 8—8 of FIG. 6.
FIG. 9 is a sectional view taken along the line 9—9 of FIG. 7.
FIG. 10 is a front elevational view of a shell spacer.
FIG. 11 is a side elevational view of the shell spacer shown in FIG. 10.
FIG. 12 is a somewhat enlarged fragmentary sectional view taken along the line 12—12 of FIG. 10.
FIG. 13 is a somewhat enlarged fragmentary side elevational view of the magazine follower.
FIG. 14 is a fragmentary front elevational view of the magazine follower shown in FIG. 13.
FIG. 16 is similar to FIG. 14 but shows another embodiment of the invention.

The illustrated box magazine 38 may be made from any suitable material, but a durable light weight plastic material is presently preferred for this purpose. The magazine has a generally rectangular housing, preferably formed by molded half sections, which includes a front wall 68, a rear wall 70, opposing sidewalls 72,73, and a bottom wall 74 which define a magazine chamber 75. The walls of the housing cooperate to define an opening at the upper end of the housing through which successive shells are received into and released from the magazine 38. The shells S,S used with the gun 10 are typical shotgun shells which have a generally cylindrical body and a rim the diameter of which is somewhat greater than the diameter of the shell body. The lateral width of the magazine chamber is somewhat greater than the diameter of an associated shell which it is designed to receive. A plurality of parallel vertically extending ribs 76,76 formed on the inner surfaces of the sidewalls 72,73 engage the bodies of shells S,S stacked within the box magazine 38 and prevent the rims of the shells from engaging the magazine sidewalls so that the shells remain in substantially axially parallel alignment with each other within the magazine. Referring to FIGS. 7 and 8 will be noted that the ribs 76,76 converge near the upper end of the magazine 38 to forming a guide channel 78 having opposing parallel walls defined by upper portions of the ribs 76,76 and a width substantially equal to the diameter of an associated shell body so that the shells, which may be stacked in generally laterally offset relation to each other in the lower portion of the magazine assume an axially parallel relationship to each other upon approaching the upper end of the magazine 38. Thus, each shell is guided along a substantially predetermined path as it leaves the magazine 38 to enter the shell receiving opening 32.

Shells are biased upwardly within the magazine 38 by a magazine follower assembly which includes a follower assembly 80 and an associated follower spring 82 which acts between the magazine and the magazine assembly follower. A negator or constant force magazine follower spring may also be used for this purpose. In FIG. 16 there is shown another magazine embodying the invention wherein a pair of negator or constant force springs 82',82' are employed to bias the follower in an upward direction. The upper ends of the springs 82',82' are connecting, respectively, to the opposite sidewalls of the magazine near the upper end of the magazine. The follower assembly 80 has a lower part 84 supported for vertical sliding movement within the magazine chamber and an upper part or cradle 86 which is supported on the lower part by a pivot pin to pivot about a laterally extending axis relative to the magazine housing. The cradle has an upwardly open arcuate recess for complimenting an associated portion of a shell body. The pivoted cradle aides in preventing the stacked shells S,S from jamming within the magazine and assures smooth passage of shells therefrom.

A magazine latch 88 is provided for releasably retaining shells S,S in the magazine 38 when the magazine is removed from an associated gun such as the shotgun 10. The magazine latch is mounted at the upper end of the magazine and supported on the sidewall 73 for pivotal movement in counterclockwise direction from a shell retaining position of FIG. 8 to a shell releasing position shown in broken lines. The magazine latch 80 is spring biased toward its shell retaining position and engages the uppermost shell in the magazine 38 when the magazine is out of the magazine shroud 34 to releaseably retain shells S,S in the magazine 38. A finger on the magazine shroud engages the magazine latch 88 to bias it to its shell releasing position when said box magazine 38 is fully positioned within the magazine shroud. A turnstile member 90 supported on the sidewall 72 near the upper end of the magazine for rotation about a generally horizontal axis operates to maintain spacing between the uppermost shell in the magazine and the shell immediately therebelow so that the rims of these adjacent shells will not attain a position of overlapping relationship relative to each other which could interfere with the loading of the firearm. The pivoted top plate on the magazine plunger prevents jamming of the shells which tend to attain a somewhat more random position relative to each other within the lower portion of the magazine.

The firearm of the present invention will fire shells which differ in length, as, example 2.75 inch, 3 inch, or 3.5 inch shells. For this reason the magazine is adjustable to accommodate shells which differ in length and includes at least one set of opposing guide tracks for selectively receiving an associated shell spacer. However, the presently preferred magazine includes a plurality of sets of opposing guide tracks 92,92 associated with the inner surfaces of the sidewalls 72 and 73 near the front of the magazine 38 to receive a shell spacer 94 in a selected one of three possible positions. Each set includes two opposing inwardly open guide tracks. The shell spacer essentially comprises an elongated strip of material adapted to the slidably received within a selected one of the sets of guide tracks. One of the guide tracks 92,92 in each set has a width dimension slightly greater than the width dimension of the other of the guide tracks in the sets to slidably receive a complementary marginal edge portion of the shell spacer 94. This arrangement prevents the shell spacer from being inserted into the magazine housing in reverse position, which could cause it to become jammed within the housing. When the magazine is loaded at least those shells S,S in the lower part of the magazine will not be in precise parallel alignment with each other due to the diametrically enlarged aim at the rear of each shell. A generally rectangular rearwardly open clearance recess 99 formed in the lower rear surface portion of the shell spacer 94 accommodates axial forward shifting of the shells within the magazine and relative to each other to compensate for this condition and prevents jamming of shells within the magazine. An upwardly and rearwardly inclined guide surface 101 at the upper end of the recess 99 engages each shell, as necessary, and moves it rearwardly into proper loading alignment as the shell approaches the upper or open end of the magazine. A resilient latch 96 at the upper end of the shell spacer 94 engages associated recesses or notches in the selected set of guide tracks and releasably retains the spacer within the selected set of tracks to adapt the magazine to accommodate a shell of selected length.

The box magazine of the present invention is adapted to be loaded in total darkness, if necessary, therefore a discriminator is provided for preventing a round of ammunition or shell S from being improperly loaded into the magazine with the rear or rim end of the shell at the forward end of the magazine. In accordance with the presently preferred embodiment of the invention, the discriminator, indicated generally by the reference numeral 98 and shown in FIGS. 10–12, comprises a pair of transversely spaced apart blocking members 100,100 which project rearwardly from the upper end of the shell spacer 94 at the forward end of the magazine.

As previously noted, the rim at the rear end of each shell S has a diameter slightly greater than the diameter of the cylindrical shell body. The blocking members 100,100 are transversely spaced apart a distance greater than the diameter of the shell body but less than the diameter of the shell rim to allow the forward end portion of a shell body to pass the block members between. The latter members prevent a shell S from being loaded into the magazine with the rim of the shell facing in the direction of the forward end of the magazine.

Firearm 10 is loaded by inserting a loaded magazine into the magazine shroud. As the magazine attains its properly seated and latched position within the magazine shroud the magazine latch 88 moves to its releasing position thereby releasing the shells in the magazine allowing the uppermost shell to move upwardly past the turnstile 90 and into and through the shell receiving opening 32 and to its ready position within the magazine tube 18 in response to the biasing force applied to the stacked shells within the magazine by the magazine follower. The portions of the guide ribs 76,76 at the upper end of the magazine direct the shell along a proper path into and past the turnstile 90 which controls movement of each successive shells S from the magazine housing into the gun and assures sufficient separation between the uppermost shell and the shell immediately therebelow so that the shell rims cannot attain an overlapping relationship to each other which could interfere with proper loading of the gun 10. Rearward movement of the forearm 23 causes a corresponding movement of the action bar assembly to move the breech bolt 20 from its battery toward and to its retired position. As the forearm moves to the rear the forearm rack 52 carried by the action bar assembly rotates the wheel and pinion assembly 60 in a clockwise direction, as viewed from below, causing rotation of the pinion 64 and rearward movement of the follower rack resulting in an accelerated movement of the plunger assembly 26 in the direction of the receiver 12. Thus, the plunger assembly 26 moves through a distance somewhat greater than the distance between the battery and retired positions of the breech bolt 20 as the breech bolt moves from its battery to its retired position. As a shell is moved from the ready position within the magazine tube 18 toward and into the receiver 12 by the plunger assembly 26 the shell is arrested by the shell stop (not shown ), located within the receiver, before the breech bolt 20 attains its fully retired position. Thereafter the action bar assembly continues to move toward the rear imparting further motion to the rack follower 52 which causes compression of the plunger spring 30. The shell stop is released during the final portion of rearward movement of the breech bolt to its retired position which releases the shell and the plunger assembly. Upon release of the shell stop kinetic energy stored in the compressed plunger spring 30 moves the shell rearwardly within the receiver to its loading position therein.

During rearward movement of the forearm 23 the axially elongated plunger 28 passes over and substantially blocks the shell receiving opening 32 thereby preventing a shell from entering the magazine tube 18 from the box magazine 38.

Return movement of the forearm to its forward position to its moves the breech bolt 20 from its retired position to its battery position and returns the plunger assembly 26 to its position forward of the ready position. When the plunger assembly attains the latter position the uppermost shell in the box magazine 38 is moved upwardly through the shell receiving opening 32 and to the ready position within the magazine tube 18 in response to upwardly directed biasing force exerted by the magazine follower 80. The firearm 10 is now ready for loading in response to the next operation of the bolt actuating mechanism. If the box magazine 38 is removed from the magazine shroud 34 while a shell is in the magazine tube 18 the shell will fall freely from the magazine tube upon removal of the box magazine from the magazine shroud. A plurality of small window openings 98,98 in the sidewalls of the box magazine permit visual inspection to determine the loaded status of the magazine. The window openings 98,98 in the upper portion of the magazine are in registry with associated windows 46,46 in the magazine shroud 34 when the box magazine 38 is properly secured within the magazine shroud and permit visual inspection to determine if there are shells in the box magazine.

I claim:

1. A firearm magazine for containing a plurality of rounds of ammunition, said magazine comprising a housing having a bottom wall, a pair of laterally opposing sidewalls and longitudinally opposing front and rear walls defining a magazine chamber and an opening at the upper end of said magazine chamber through which successive rounds of ammunition are released from said magazine, follower means for biasing rounds of ammunition contained within said magazine chamber in an upward direction toward said opening, and adjusting means for selectively changing the effective longitudinal extent of said magazine chamber to accommodate rounds of ammunition of differing lengths including at least one set of vertically disposed opposing guide tracks on said opposing sidewalls and an elongated spacer for selective positioning in said one set.

2. A firearm magazine as set forth in claim 1 including spacer retaining means for releasably retaining the spacer in a selected one of said sets.

3. A firearm as set forth in claim 2 wherein said spacer retaining means comprises a latch member on said spacer.

4. A firearm magazine as set forth in claim 1 including a vertically extending series of window openings through one of said sidewalls.

5. A firearm magazine for containing a plurality of rounds of ammunition, said magazine comprising a housing having a bottom wall, a pair of laterally opposing sidewalls and longitudinally opposing front and rear walls defining a magazine chamber and an opening at its upper end through which successive rounds of ammunition are released from said magazine chamber, follower means for biasing rounds of ammunition contained within said magazine chamber upward and in the direction of said opening, and adjusting means for altering the effective longitudinal extent of said magazine chamber to accommodate rounds of ammunition of differing lengths within said magazine chamber and including an elongate spacer, supporting means for maintaining said spacer in a vertically extending position within said magazine chamber, and at least one set of guide tracks for receiving said spacer.

6. A box magazine for a firearm as set forth in claim 5 including spacer retaining means for releasably securing said spacer in said housing.

7. A firearm magazine as set forth in claim 5 wherein each round of ammunition has a front end and a rear end and said magazine includes discriminating means on said spacer for preventing a round of ammunition from being loaded into said magazine through said opening with the rear end of the round at the front end of the magazine.

8. A firearm magazine as set forth in claim 7 wherein the rear end portion of each round has a width dimension greater than the width dimension of the forward end portion thereof and said discriminating means comprises blocking means for permitting passage of the forward end portion of a round therethrough and into said magazine chamber and blocking passage of the rear end portion of a round therethrough and into said magazine.

9. A firearm as set forth in claim 7 wherein said discriminating means includes a pair of transversely spaced apart blocking members mounted on and projecting rearwardly from said spacer.

10. A firearm magazine as set forth in claim 5 wherein said follower means includes a follower and a constant force spring acting between said follower and said magazine housing.

11. A firearm magazine as set forth in claim 5 including means for preventing improper positioning of said spacer in said one set of guide tracks.

12. A firearm magazine as set forth in claim 11 wherein said means for preventing improper positioning comprises said guide tracks being of differing widths to receive said spacer in only one position therein.

13. A box magazine for a firearm and comprising a housing for receiving and retaining a plurality of rounds of ammunition for the firearm arranged in generally axially parallel relation therein, said housing having a bottom wall, opposing sidewalls and front and rear walls and defining an opening at its upper end for receiving and releasing successive rounds of ammunition therethrough, a follower disposed within said housing, a follower spring biasing said follower upward and in the direction of said opening for urging the rounds of ammunition contained within said housing in the direction of said opening, retaining means for releasably securing the rounds of ammunition within the housing when the housing is removed from the firearm and including a retaining latch supported on one of said walls in proximity to said opening for movement between ammunition retaining and ammunition releasing positions, controlling means for releasing successive rounds of ammunition from said housing in a controlled manner when said retaining means is in its ammunition releasing position, and adjusting means for adapting said magazine to dispense shells of differing lengths including a plurality of sets of opposing guide tracks defined by said opposing sidewalls and an elongated shell spacer for selective positioning in an associated one of said sets of guide tracks.

14. A box magazine as set forth in claim 13 wherein said controlling means comprises a turnstile journalled for rotation on said housing near said opening.

15. A shotgun magazine for positioning within the magazine receiver of an associated shotgun and containing a plurality of shotgun shells, each shell having a generally cylindrical body and a rim having a diameter larger than the diameter of the cylindrical body thereof, said magazine comprising a housing having a bottom wall, laterally opposing sidewalls, front and rear walls and defining an opening at its upper end through which successive shells are received into and released from said housing, follower means within said housing for biasing shells contained within said housing upward and in the direction of said opening, aligning means for maintaining shells in substantially axially parallel alignment with each other within said housing, retaining means for releasably retaining shells within said housing when said magazine is removed from the magazine receiver of an associated shotgun and releasing shells from said housing when said magazine is properly positioned within the magazine receiver of an associated shotgun, controlling means for controlling movement of each successive shell from said housing through said opening and into an associated shotgun, and adjusting means for adapting said magazine to dispense shells of differing lengths and including a plurality of sets of laterally opposing guide tracks on said opposing sidewalls and an elongated shell spacer for selective positioning in an associated one of said sets.

16. A shotgun magazine as set forth in claim 15 wherein said follower means comprises a follower assembly including a follower supported for vertical reciprocal movement within said housing, a shell cradle supported on said follower for reciprocal movement with said follower and pivotal movement relative to said follower.

17. A shotgun magazine as set forth in claim 15 wherein said shell cradle is supported for pivotal movement about a laterally extending axis and has an arcuate upwardly facing cradle surface for substantially complementing an associated portion of a shell body.

18. A shotgun magazine as set forth in claim 15 wherein said aligning means comprises generally vertically extending alignment ribs projecting laterally inward from said opposing sidewalls.

19. A shotgun magazine as set forth in claim 18 wherein the lateral spacing between said ribs within the lower portion of said housing is substantially greater than the diameter of an associated shell body and said ribs converge near the upper end portion of said magazine to form a guide channel having a lateral width substantially equal to the diameter of an associated shell body.

20. A shotgun magazine as set forth in claim 15 wherein said retaining means comprises a latch supported on said housing for movement between shell retaining and shell releasing positions and means for moving said latch to its shell releasing position in response to positioning of the magazine within the magazine receiver of an associated shotgun.

21. A shotgun magazine as set forth in claim 20 wherein said latch is supported for pivotal movement relative to said housing.

22. A shotgun magazine as set forth in claim 15 wherein said controlling means comprises a turnstile.

23. A shotgun magazine as set forth in claim 22 wherein said turnstile is supported for rotary movement by an associated one of said sidewalls.

24. A shotgun magazine as set forth in claim 15 including means for releasably retaining said shell spacer in said housing.

25. A shotgun magazine as set forth in claim 15 including a vertically extending series of window openings through one of said walls.

* * * * *